US007863231B2

(12) United States Patent
Ahn et al.

(10) Patent No.: US 7,863,231 B2
(45) Date of Patent: Jan. 4, 2011

(54) THINNER COMPOSITION AND METHOD OF REMOVING PHOTORESIST USING THE SAME

(75) Inventors: Seung-Hyun Ahn, Suwon-si (KR); Eun-Mi Bae, Yongin-si (KR); Baik-Soon Choi, Anyang-si (KR); Sang-Mun Chon, Yongin-si (KR); Dae-Joung Kim, Suwon-si (KR); Kwang-sub Yoon, Seoul (KR); Sang-Kyu Park, Hwasung-si (KR); Jae-Ho Kim, Yongin-si (KR); Shi-Yong Yi, Sungnam-si (KR); Kyoung-Mi Kim, Anyang-si (KR); Yeu-Young Youn, Seoul (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 344 days.

(21) Appl. No.: 12/118,778

(22) Filed: May 12, 2008

(65) Prior Publication Data

US 2008/0214422 A1 Sep. 4, 2008

Related U.S. Application Data

(62) Division of application No. 11/049,751, filed on Feb. 4, 2005, now Pat. No. 7,387,988.

(30) Foreign Application Priority Data

Feb. 10, 2004 (KR) ..... 2004-8678

(51) Int. Cl.
*C11D 7/50* (2006.01)

(52) U.S. Cl. ..... 510/175

(58) Field of Classification Search ..... 510/175
See application file for complete search history.

(56) References Cited

U.S. PATENT DOCUMENTS

| | | | | |
|---|---|---|---|---|
| 4,965,167 | A * | 10/1990 | Salamy | 430/191 |
| 5,372,742 | A * | 12/1994 | Bayless | 510/118 |
| 5,750,632 | A | 5/1998 | Rahman et al. | |
| 5,866,305 | A | 2/1999 | Chon et al. | |
| 5,952,150 | A | 9/1999 | Ohta et al. | |
| 6,159,646 | A | 12/2000 | Jeon et al. | |
| 6,399,267 | B1 * | 6/2002 | Nishimura et al. | 430/192 |
| 7,063,934 | B2 * | 6/2006 | Saito et al. | 430/276.1 |
| 7,387,988 | B2 * | 6/2008 | Ahn et al. | 510/175 |
| 2003/0054284 | A1 * | 3/2003 | Suzuki et al. | 430/192 |
| 2003/0157441 | A1 | 8/2003 | Ahn et al. | |
| 2004/0067437 | A1 * | 4/2004 | Wayton et al. | 430/271.1 |
| 2005/0176607 | A1 * | 8/2005 | Ahn et al. | 510/176 |
| 2007/0161530 | A1 * | 7/2007 | Kaneda et al. | 510/176 |
| 2008/0214422 | A1 * | 9/2008 | Ahn et al. | 510/176 |

FOREIGN PATENT DOCUMENTS

| | | |
|---|---|---|
| JP | 7-271054 | 10/1995 |
| JP | 07-281425 | 10/1995 |
| KR | 2001077101 A | 8/2001 |
| KR | 1020030051129 A | 6/2003 |

* cited by examiner

*Primary Examiner*—Gregory E Webb
(74) *Attorney, Agent, or Firm*—Volentine & Whitt, PLLC

(57) ABSTRACT

A thinner composition includes propylene glycol ether acetate, methyl 2-hydroxy-2-methyl propionate, and an ester compound such as ethyl lactate, ethyl 3-ethoxy propionate or a mixture thereof.

6 Claims, 2 Drawing Sheets

THINNER COMPOSITION AND METHOD OF REMOVING PHOTORESIST USING THE SAME

CROSS-REFERENCE TO RELATED APPLICATIONS

This is a divisional of application Ser. No. 11/049,751, filed Feb. 4, 2005, now U.S. Pat. No. 7,387,988 which is incorporated herein by reference in its entirety.

BACKGROUND OF THE INVENTION

1. Field of the Invention

The present invention generally relates to a thinner composition and a method of removing a photoresist using the thinner composition. More particularly, the present invention generally relates to a thinner composition having improved solubility properties and a method of efficiently removing an edge bead relative to various photoresist or anti-reflective materials using the thinner composition.

A claim of priority is made to Korean Patent Application No. 2004-8678 filed on Feb. 10, 2004, the contents of which are incorporated by reference in their entirety.

2. Description of the Related Art

Semiconductor devices having a high degree of integration and rapid response speed are desired as information processing apparatuses continue to develop. Hence, the technology for manufacturing semiconductor devices has developed to improve the degree of integration, reliability, and response speeds of the semiconductor devices.

To manufacture a conventional microcircuit, for example, impurities are precisely implanted into regions on a silicon substrate, and then the impurity regions are electrically connected to each other to form a very large scale integration (VLSI) circuit. A photolithography process is used to form patterns, which define the impurity regions. After forming a photoresist film on the substrate, the photoresist film is exposed to light such as an ultra violet ray, an e-beam, or an X-ray. The photoresist film is developed and then exposed portions on the substrate are removed.

Conventionally, a photoresist is coated while a substrate is rotated such as a spin coating process; the photoresist evenly coats on an edge and backside of the substrate. However, the photoresist coated on the edge or the backside of the substrate generates particles known as an edge bead, which may cause process failure in subsequent processes such as an etching process or an ion implanting process. Therefore, an edge bead removal (EBR) process using a thinner composition is generally required to remove the unwanted particles from the substrate.

Sometimes, a failure of a photoresist pattern may occur during a photolithography process. When the failure of the photoresist pattern occurs, a reworking process is performed to remove the failed photoresist pattern from the substrate. The reworking process is used to save the substrate.

As patterns on semiconductor devices become finer, photoresist compositions have been developed by an I-line ray or a G-line ray. A photoresist composition generally includes a novolak resin as the main ingredient. In addition, an amplified photoresist that is sensitive to an excimer laser or an extreme ultraviolet ray has been used to manufacture semiconductor devices. Thus, a thinner composition having good solubility relative to these types of photoresist is required.

U.S. Pat. No. 5,866,305 discloses, for example, a thinner composition containing ethyl lactate and ethyl 3-ethoxy propionate, and also discloses another thinner composition containing ethyl lactate, ethyl 3-ethoxy propionate, and gamma-butyro lactone. Although widely used, the above-mentioned thinner compositions have poor solubility relative to certain photoresists such as amplified photoresist. In addition, the thinner compositions are relatively expensive due to ethyl 3-ethoxy propionate, which is used as the main ingredient. Further, the thinner composition has poor solubility and EBR characteristics relative to photoresist using an argon fluoride (ArF) laser.

U.S. Pat. No. 6,159,646 discloses another conventional thinner composition containing ethyl lactate and gamma-butyro lactone; a thinner composition containing ethyl lactate, ethyl 3-ethoxy propionate, and gamma-butyro lactone; and, a thinner composition containing ethyl lactate and ethyl 3-ethoxy propionate. The cost to prepare thinner compositions containing ethyl 3-ethoxy propionate and gamma-butyro lactone is substantially high. These thinner compositions also have substantially poor solubility relative to photoresists using an ArF laser.

The above-described conventional thinner compositions are employed in reworking processes and in EBR processes; however, the thinner compositions are inappropriate for both processes.

A thinner composition containing an acetic acid ester compound, gamma-butyro lactone, and a non-acetate type ester, as disclosed in Korean Patent Laid Open Publication No. 2003-51129, is effective in removing photoresist using an I-line ray, a G-line ray, and krypton fluoride laser in a reworking process or an EBR process. However, the thinner composition has poor solubility relative to a photoresist using an ArF laser. In addition, the thinner composition has poor EBR characteristics. A thinner composition having good solubility relative to THE photoresist exposed to an ArF laser, which effectively removes unwanted photoresist in an EBR process, and is effective in a reworking process is required.

SUMMARY OF THE INVENTION

The present invention provides a thinner composition having excellent solubility properties, edge bead removal characteristics, and reworking characteristics relative to types of photoresist and types anti reflective layer.

In accordance with one aspect of the present invention, a thinner composition includes propylene glycol ether acetate, at least one ester compound selected from the group consisting of ethyl lactate, ethyl 3-ethoxy propionate, and a mixture thereof, and methyl 2-hydroxy-2-methyl propionate.

Another embodiment of the present invention provides a thinner composition including about 30 to about 65 weight percent of the propylene glycol monomethyl ether acetate, about 15 to about 50 weight percent of the ethyl 3-ethoxy propionate, and about 20 to about 55 weight percent of the methyl 2-hydroxy-2-methyl propionate.

A method of removing a photoresist using the thinner composition of the present invention by forming a photoresist film on a substrate, and removing the photoresist film from the substrate using a thinner composition comprising propylene glycol ether acetate, methyl 2-hydroxy-2-methyl propionate, and at least one ester compound selected from the group consisting of ethyl lactate, ethyl 3-ethoxy propionate, and a mixture thereof.

BRIEF DESCRIPTION OF THE DRAWINGS

Aspects of the present invention will become readily apparent by reference to the following detailed description when considered in conjunction with the accompanying drawings.

DESCRIPTION OF THE INVENTION

Figure 1:
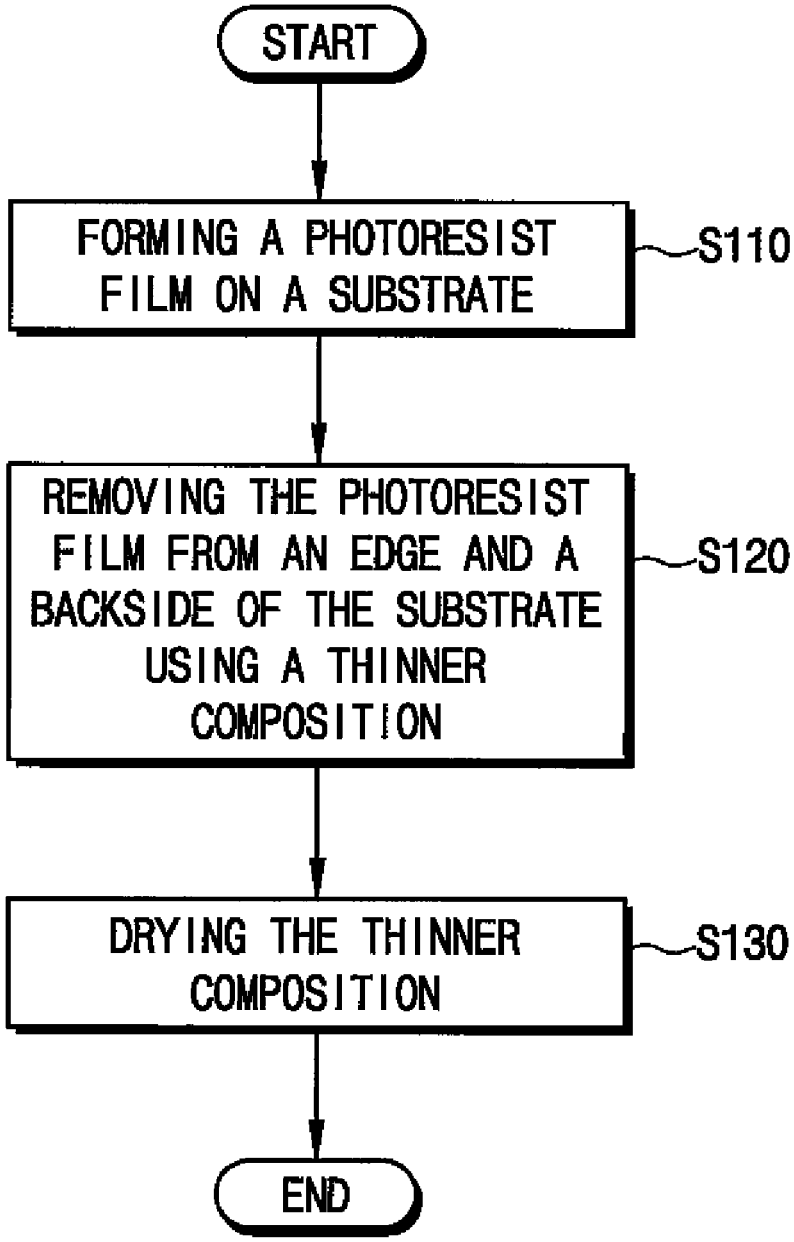
FIG. 1 is a flow chart illustrating a method of removing photoresist using a thinner composition in accordance with an embodiment of the present invention.

The present invention now will be described more fully hereinafter with reference to the accompanying drawings, in which embodiments of the invention are shown. The present invention may, however, be embodied in many different forms and should not be construed as limited to the embodiments set forth herein; rather, these embodiments are provided as working examples. It will be understood that when an element such as a layer, a region or a substrate is referred to as being "on" or "onto" another element, it can be directly on the other element or intervening elements may also be present.

The present invention provides a thinner composition having improved solubility characteristics, edge bead removal (EBR) characteristics, and reworking characteristics with respect to a photoresist film that is exposed by an argon fluoride (ArF) laser.

The thinner composition of the present invention contains propylene glycol ether acetate, an ester compound, and methyl 2-hydroxy-2-methyl propionate. Additionally, propylene glycol ether acetate may include propylene glycol monomethyl ether acetate or propylene glycol monoethyl ether acetate. These chemicals can be used alone or in a combination thereof.

When ethyl lactate (EL) is used as the ester compound, the content of propylene glycol monomethyl ether acetate in the thinner composition is preferably in a range of about 40 to about 75 weight percent.

When the thinner composition includes more than about 75 weight percent of propylene glycol monomethyl ether acetate, the solubility of the thinner composition goes down. When the thinner composition includes less than about 40 weight percent of propylene glycol monomethyl ether acetate, the viscosity of the thinner composition goes up, which deteriorates the EBR characteristics relative to a photoresist. Thus, the thinner composition preferably includes about 40 to about 75 weight percent of propylene glycol monomethyl ether acetate. More preferably, the thinner composition includes about 50 to about 60 weight percent of propylene glycol monomethyl ether acetate.

When ethyl 3-ethoxy propionate (EEP) is used as the ester compound, the content of propylene glycol monomethyl ether acetate in the thinner composition is preferably in a range of about 30 to about 65 weight percent.

When the thinner composition includes more than about 65 weight percent of propylene glycol monomethyl ether acetate, the solubility of the thinner composition is reduced. When the thinner composition includes less than about 30 weight percent of propylene glycol monomethyl ether acetate, the viscosity of the thinner composition goes up, which deteriorates the EBR characteristics relative to a photoresist. Thus, the thinner composition preferably includes about 30 to about 65 weight percent of propylene glycol monomethyl ether acetate.

The thinner composition of the present invention includes an ester compound. The ester compound preferably includes ethyl lactate or ethyl 3-ethoxy propionate. These chemicals can be used alone or in a combination thereof.

When ethyl lactate is used as the ester compound, the thinner composition preferably includes about 5 to about 45 weight percent of ethyl lactate. When the thinner composition includes more than about 45 weight percent of ethyl lactate, the solubility of the thinner composition is poor, and the EBR profile deteriorates. When the thinner composition includes less than about 5 weight percent of ethyl lactate, the EBR characteristics of the thinner composition deteriorates relative to a photoresist. Thus, the content of ethyl lactate in the thinner composition is preferably in a range of about 5 to about 45 weight percent.

When ethyl 3-ethoxy propionate is used as the ester compound, the thinner composition preferably includes about 15 to about 50 weight percent of ethyl 3-ethoxy propionate. When the thinner composition includes more than about 50 weight percent of ethyl 3-ethoxy propionate, the solubility of the thinner composition is poor. When the thinner composition includes less than about 15 weight percent of ethyl 3-ethoxy propionate, the EBR characteristics of the thinner composition deteriorates relative to a photoresist. Thus, the content of ethyl 3-ethoxy propionate in the thinner composition is preferably in a range of about 15 to about 50 weight percent. For example, the content of ethyl 3-ethoxy propionate is in a range of about 15 to about 40 weight percent.

The thinner composition of the present invention includes methyl 2-hydroxy-2-methyl propionate.

When ethyl lactate is used as the ester compound, the thinner composition preferably includes about 15 to about 50 weight percent of methyl 2-hydroxy-2-methyl propionate. When the thinner composition includes less than about 15 weight percent of methyl 2-hydroxy-2-methyl propionate, the solubility of the thinner composition goes down relative to a photoresist. When the thinner composition includes more than about 50 weight percent of methyl 2-hydroxy-2-methyl propionate, the viscosity of the thinner composition increases, and the EBR characteristics of the thinner composition deteriorate relative to a photoresist. Thus, the content of methyl 2-hydroxy-2-methyl propionate in the thinner composition is preferably in a range of about 15 to about 50 weight percent. More preferably, the content of methyl 2-hydroxy-2-methyl propionate is in a range of about 30 to about 40 weight percent.

When ethyl 3-ethoxy propionate is used as the ester compound, the thinner composition preferably includes about 20 to about 55 weight percent of methyl 2-hydroxy-2-methyl propionate. When the thinner composition includes less than about 20 weight percent of methyl 2-hydroxy-2-methyl propionate, the solubility of the thinner composition goes down. When the thinner composition includes more than about 55 weight percent of methyl 2-hydroxy-2-methyl propionate, the viscosity of the thinner composition goes up, which deteriorates the EBR characteristics relative to a photoresist. Thus, the content of methyl 2-hydroxy-2-methyl propionate in the thinner composition is preferably in a range of about 20 to about 55 weight percent. More preferably, the content of methyl 2-hydroxy-2-methyl propionate is in a range of about 30 to about 40 weight percent.

The thinner composition may additionally include a surfactant such as a fluoric surfactant, an ionic surfactant, and a non-ionic surfactant. The thinner composition may also include about 10 to about 550 weight ppm of the surfactant.

The present invention now will be described more fully hereinafter with reference to examples and comparative examples. The present invention should not be construed as limited to the examples set forth herein.

Example 1

To prepare a thinner composition, about 50 weight percent of propylene glycol monomethyl ether acetate, about 10 weight percent of ethyl lactate, and about 40 weight percent of methyl 2-hydroxy-2-methyl propionate were mixed in a container. The viscosity of the obtained thinner composition was about 1.5 cP at a temperature of about 25° C.

Example 2

To prepare a second thinner composition, about 45 weight percent of propylene glycol monomethyl ether acetate, about 15 weight percent of ethyl 3-ethoxy propionate, and about 40 weight percent of methyl 2-hydroxy-2-methyl propionate were mixed in a container. The viscosity of the obtained second thinner composition was about 1.4 cP at a temperature of about 25° C.

Comparative Example 1

To prepare a comparative thinner composition, propylene glycol monomethyl ether acetate, gamma-butyro lactone, and ethyl 3-ethoxy propionate were mixed in a container. The comparative thinner composition included about 73 weight percent of propylene glycol monomethyl ether acetate, about 25 weight percent of ethylene 3-ethoxy propionate, and about 2 weight percent of gamma-butyro lactone. The viscosity of the obtained comparative thinner composition was about 1.3 cP at a temperature of about 25° C.

Comparative Example 2

To prepare a second comparative thinner composition, ethyl 3-ethoxy propionate, ethyl lactate and gamma-butyro lactone were mixed in a container. The second comparative thinner composition included about 75 weight percent of ethyl 3-ethoxy propionate, about 20 weight percent of ethyl lactate, and about 5 weight percent of gamma-butyro lactone. The viscosity of the obtained second comparative thinner composition was about 1.3 cP at a temperature of about 25° C.

Comparative Example 3

A third comparative thinner composition included only propylene glycol monomethyl ether acetate. The viscosity of the obtained third comparative thinner composition was about 1.2 cP at a temperature of about 25° C.

Comparative Example 4

A fourth comparative thinner composition only included ethyl 3-ethoxy propionate. The viscosity of the obtained fourth comparative thinner composition was about 1.2 cP at a temperature of about 25° C.

Comparative Example 5

To prepare a fifth comparative thinner composition, propylene glycol monomethyl ether acetate, propylene glycol monomethyl ether, and gamma-butyro lactone were mixed in a container. The thinner composition included about 70 weight percent of propylene glycol monomethyl ether acetate, about 20 weight percent of propylene glycol monomethyl ether, and about 5 weight percent of gamma-butyro lactone. The viscosity of the obtained fifth comparative thinner composition was about 1.3 cP at a temperature of about 25° C.

Estimation of Solubility Rate Relative to a Type of Photoresist

Experiment 1

The solubility rate relative to a typical photoresist was measured using the thinner composition prepared in Example 1. About 4.0 cc of SEPR-430 (manufactured by Shin-Etsu), a photoresist to be exposed by a krypton fluoride laser was spin-coated on a substrate and successively soft baked at a temperature of about 100° C. The photoresist film thus formed had a thickness of about 12,000 Å. The substrate including the photoresist film was dipped in the thinner composition to strip the photoresist film, and then the solubility rate was measured. The observed solubility rate was equal to or greater than about 12,000 Å/sec.

Experiment 2

About 4.0 cc of ip-3300™ (manufactured by TOK), a photoresist to be exposed by an I-line ray was spin-coated on a substrate and successively soft baked at a temperature of about 90° C. The photoresist film thus formed had a thickness of about 12,000 Å. The substrate including the photoresist film was dipped in the thinner composition to strip the photoresist film, and then the solubility rate was measured. The observed solubility rate was equaled to or greater than about 12,000 Å/sec.

Experiment 3

About 4.0 cc of RHR3640™ (manufactured by Shin-Etsu), a photoresist to be exposed by an argon fluoride laser was spin-coated on a substrate and successively soft baked at a temperature of about 105° C. The photoresist film thus formed had a thickness of about 2,700 Å. The substrate including the photoresist film was dipped in the thinner composition to strip the photoresist film, and then the solubility rate was measured. The observed solubility rate was equaled to or greater than about 2,700 Å/sec.

Experiment 4

About 4.0 cc of AR46™ (manufactured by Shipley), an anti reflective material to be exposed by an argon fluoride laser was spin-coated on a substrate, but was not successively soft baked. The obtained anti-reflective layer had a thickness of about 380 Å. The substrate including the anti-reflective layer was dipped in the thinner composition to strip the anti-reflective layer, and then the solubility rate was measured. The observed solubility rate was equal or greater than about 380 Å/sec.

According to Experiments 1 to 4, the thinner composition prepared in Example 1 had excellent solubility rate with respect to all the different types of photoresist. Thus, the thinner composition of the present invention may be used to remove photoresist from a wafer.

Estimation of Solvency Relative to a Type of Photoresist

The solvency of the thinner compositions prepared in Examples 1 and 2 and Comparative Examples 1 to 5 were estimated. The estimated results are given in the following Table 1. The solvencies were estimated based on the soluble amount of the photoresists when a mixing ratio of a thinner composition relative to a photoresist was about 5:1

TABLE 1

| Type of photoresist | PR-1 (SEPR-430) | PR-2 (ip-3300) | PR-3 (RHR3640) | PR-4 (AR46) |
|---|---|---|---|---|
| Example 1 | E | E | E | E |
| Example 2 | E | E | E | E |
| Comparative Example 1 | E | E | R | X |
| Comparative Example 2 | E | E | R | X |
| Comparative Example 3 | E | E | R | X |
| Comparative Example 4 | E | E | X | X |
| Comparative Example 5 | E | E | E | E |

In Table 1, "E" means excellent solvency. That is, sufficient amount of the photoresist dissolved in the thinner composition. "R" means average solvency. Namely, some portions of the photoresist may precipitate out after 24 hours after mixing. "X" represents poor solvency. That is, the photoresist may immediately precipitate after the photoresist is mixed with the thinner composition.

As shown in Table 1, the thinner compositions prepared in Examples 1 and 2 have excellent solvency regardless of the type of photoresist. The thinner composition prepared in Comparative Example 5 had good solvency but bad EBR characteristic.

Estimation of EBR Characteristic Relative to a Type of Photoresist

EBR properties of Examples 1 and 2 and Comparative Examples 1 to 5 relative to the types of photoresist were estimated. The EBR characteristics were estimated by a coater (manufactured by TEL Co., Ltd. in Japan) and by pressurizing a substrate using nitrogen ($N_2$) gas. The pressure was about 0.7 to about 1.0 kg/cm$^2$, and the nitrogen gas was provided to the substrate at a flow rate of about 13 to about 20 cc/min for about 6 seconds. Results are given in the following Table 2.

TABLE 2

| Type of photoresist | PR-1 (SEPR-430) | PR-2 (ip-3300) | PR-3 (RHR3640) | PR-4 (AR46) |
|---|---|---|---|---|
| Example 1 | N | N | N | N |
| Example 2 | N | N | N | N |
| Comparative Example 1 | N | U | U | X |
| Comparative Example 2 | N | U | X | X |
| Comparative Example 3 | U | U | U | X |
| Comparative Example 4 | U | U | U | U |
| Comparative Example 5 | N | — | X | X |

In Table 2, "N" represents no residue photoresist on the substrate after an EBR process with a clean EBR line. "U" represents no residue photoresist on substrate after an EBR process, but the EBR line is not clean. "X" represents presence of residue photoresist on the substrate after an EBR process was performed, and an unclean EBR line.

As shown in Table 2, the thinner compositions prepared in Examples 1 and 2 effectively removed photoresist regardless of the type of photoresist. However, when the thinner composition prepared in Comparative Examples 1, 2 and 5 were used in the EBR process, residue photoresist remained on the substrate, although the thinner compositions had good EBR characteristics relative to the SEPR-430 photoresist. In addition, when the thinner composition prepared in Comparative Examples 3 and 4 were used in the EBR process, residue photoresist also remained on the substrate.

As described above, the novel thinner compositions of the present invention may effectively remove photoresist regardless of a type thereof and may not damage the underlying layers. Particularly, the thinner composition may effectively remove photoresist or anti reflective material exposed to an argon fluoride laser. Thus, the thinner composition of the present invention may be employed to manufacture a semiconductor device having a design rule of less than about 90 nm. In addition, the thinner composition is environmental friendly. Thus, a highly integrated semiconductor device having improved reliability may be economically manufactured.

The present invention provides a method of removing photoresist using the thinner composition of the present invention.

FIG. 1 is a flow chart illustrating a method of removing photoresist using the thinner composition of the present invention.

In step S10, a photoresist film is formed on a substrate. In step S120, the photoresist film is removed from the substrate using the thinner composition.

In detail, a spin-coater is used to form the photoresist film on the substrate in step S110. That is, the photoresist is coated on the substrate while the substrate is rotated by the spin-coater. In accordance with the rotation of the substrate, the photoresist spreads to an edge of the substrate by centrifugal force uniformly coating the photoresist on the substrate. The photoresist spreads to the edge portion of the substrate and the backside of the substrate by the centrifugal force.

In step S120, the photoresist film is removed from the substrate using the thinner composition of the present invention, which includes propylene glycol ether acetate, an ester compound, and methyl 2-hydroxy-2-methyl propionate.

The thinner composition spreads on the edge and backside of the substrate to remove the photoresist from the substrate. Here, the thinner composition may be sprayed on the edge and/or backside of the substrate while rotating the substrate. Specifically, the substrate may be rotated with a spin-chuck, and the thinner composition may be sprayed with a nozzle.

In step S130, after removing the photoresist film from the substrate using the thinner composition, an EBR process is performed to dry the thinner composition on the substrate.

According to this embodiment, contaminations on the substrate generated by the photoresist are effectively prevented.

Figure 2:
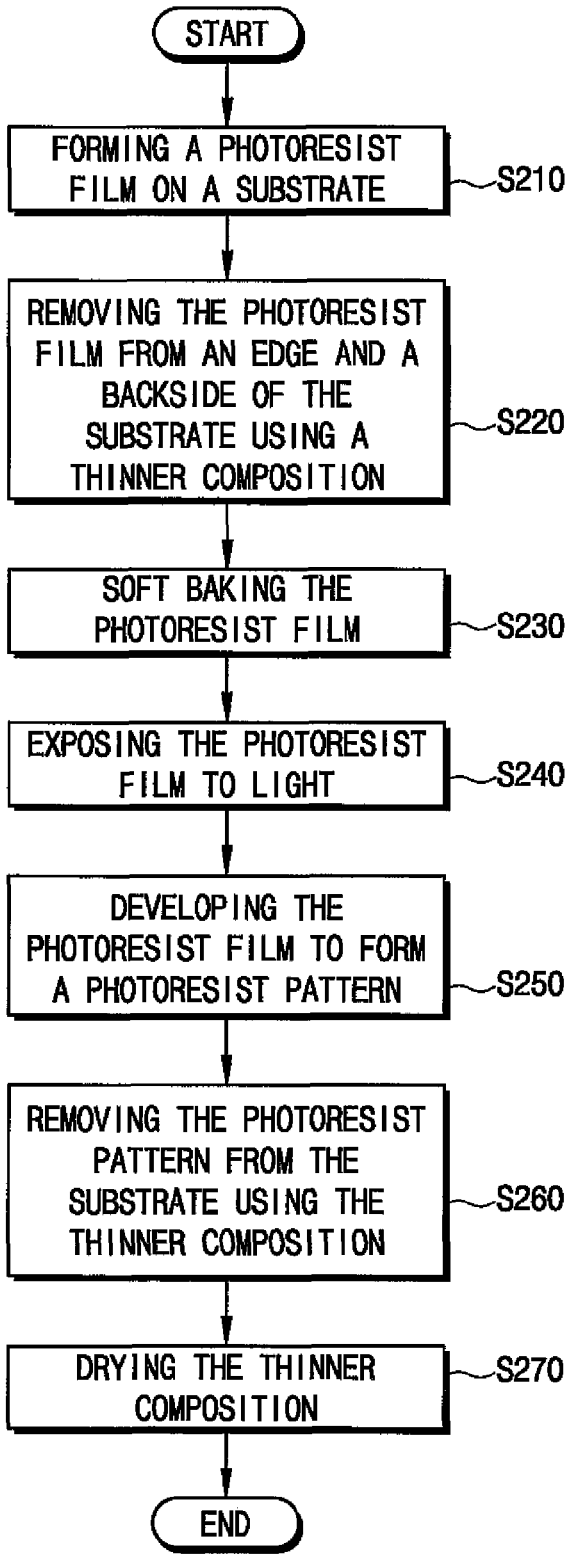
FIG. 2 is a flow chart illustrating a method of removing photoresist using a thinner composition in accordance with another embodiment of the present invention.

FIG. 2 is a flow chart illustrating another method of removing photoresist using the thinner composition of the present invention.

In steps S210 to S250, a photoresist pattern is formed on a substrate. In step S260, the photoresist pattern is removed from the substrate using the thinner composition of the present invention.

In detail, a photoresist film is formed on the substrate in step S210. The substrate is preferably a silicon substrate for a semiconductor device or a transparent substrate for a liquid crystal display device. The substrate may include an underlying structure to be patterned by a photolithography process. Here, the underlying structure may include an oxide layer, a nitride layer, a silicon layer, and a metal layer.

Photosensitive material is coated on the substrate to form the photoresist film thereon. The photosensitive material is either a positive or negative photosensitive material. A positive photosensitive material when partially exposed to light may be removed from the substrate in a subsequent developing process.

In addition, hexamethyldisilazane may be coated on the substrate to enhance an adhesive strength between the photoresist film and the substrate. Further, an anti-reflective layer may be formed to prevent diffused reflection of the light in a successive photo process and developing process.

In step S220, after forming the photoresist film on the substrate, an EBR process may be carried out to prevent contamination on the substrate. Portions of the photoresist film formed on the edge and backside of the substrate is preferably removed using the thinner composition of the present invention containing propylene glycol ether acetate, an ester compound, and methyl 2-hydroxy-2-methyl propionate in the EBR process.

In step S230, a soft baking process is performed to remove any remaining moisture from the photoresist film.

In step S240, the photoresist film is partially exposed to light using a photo mask. After the photo mask having a pattern is positioned over the photoresist film, predetermined portions of the photoresist film are selectively exposed to light passing through the mask. For example, the light may be a G-line ray, an I-line ray, a krypton fluoride (KrF) laser, an argon fluoride (ArF) laser, an e-beam, or X-ray. Thus, the exposed portions of the photoresist film have solubility substantially different from that of unexposed portions of the photoresist film.

In step S250, the photoresist film is developed using a developing solution such as tetra methyl ammonium hydroxide (TMAH) to complete the photoresist pattern. When the photoresist film includes a positive photosensitive material, the exposed portions of the photoresist film are removed from the substrate.

The photoresist pattern formed by the above-described processes may be employed to form various fine patterns on the semiconductor device. However, when a photoresist pattern failure occurs, removing the photoresist pattern on the substrate and reusing the substrate is advantageous from an economical viewpoint. Hence in step S260, if there is a photoresist pattern failure, a reworking process is performed to remove the photoresist pattern from the substrate.

In detail, the photoresist pattern is removed from the substrate using the thinner composition of the present invention.

In step S270, a drying process is preferably performed to remove any residual thinner composition on the substrate.

What is claimed is:

1. A thinner composition comprising:

about 40 to about 75 weight percent of propylene glycol monomethyl ether acetate;

about 5 to about 45 weight percent of ethyl lactate; and about 15 to about 50 weight percent of methyl 2-hydroxy-2-methyl propionate.

2. The composition of claim 1, further comprising a surfactant.

3. The composition of claim 2, wherein the surfactant comprises a fluoric surfactant, a non-ionic surfactant, or an ionic surfactant.

4. The composition of claim 3, wherein the thinner composition contains about 10 to about 550 ppm of the surfactant.

5. A thinner composition comprising:

about 30 to about 65 weight percent of propylene glycol monomethyl ether acetate;

about 15 to about 50 weight percent of ethyl 3-ethoxy propionate; and about 20 to about 55 weight percent of methyl 2-hydroxy-2-methyl propionate.

6. The composition of claim 5, further comprising a fluoric surfactant, a non-ionic surfactant, or an ionic surfactant in an amount of about 10 to about 550 ppm.

* * * * *